US006029134A

United States Patent [19]

Nishiguchi et al.

[11] Patent Number: 6,029,134

[45] Date of Patent: Feb. 22, 2000

[54] METHOD AND APPARATUS FOR SYNTHESIZING SPEECH

[75] Inventors: Masayuki Nishiguchi; Jun Matsumoto, both of Kanagawa, Japan

[73] Assignee: Sony Corporation, Tokyo, Japan

[21] Appl. No.: 08/718,241

[22] Filed: Sep. 20, 1996

[30] Foreign Application Priority Data

Sep. 28, 1995 [JP] Japan ..... P07-250983

[51] Int. Cl.[7] ..... G10L 3/02

[52] U.S. Cl. ..... 704/268; 704/262

[58] Field of Search ..... 704/258, 206, 704/216, 268, 266, 207, 208, 262, 263

[56] References Cited

U.S. PATENT DOCUMENTS

| | | | |
|---|---|---|---|
| 5,179,626 | 1/1993 | Thompson | 395/2.58 |
| 5,216,747 | 6/1993 | Hardwick et al. | 704/206 |
| 5,504,834 | 4/1996 | Fette et al. | 395/2.16 |
| 5,581,656 | 12/1996 | Hardwick et al. | 395/2.67 |
| 5,664,051 | 9/1997 | Hardwick et al. | 704/206 |

FOREIGN PATENT DOCUMENTS

| | | | |
|---|---|---|---|
| 0566131 | 4/1993 | European Pat. Off. | G10L 3/00 |

OTHER PUBLICATIONS

Yang G. et al. "Band–Widened Harmonic Vocoder at 2 to 4 KBPS" (ICASSP), I.E.E.E, vol. 1, May 9, 1995; p. 504–507.

Yang H. et al. "Quadratic Phase Interpolation for Voiced Speech Synthesis in MBE Model" Electronics Letters, vol. 29, No. 10, May 13, 1993; p. 856–857.

*Primary Examiner*—Richemond Dorvil
*Attorney, Agent, or Firm*—Jay H. Maioli

[57] ABSTRACT

A speech synthesizing method and apparatus arranged to use a sinusoidal waveform synthesis technique provide for preventing degradation of acoustic quality caused by the shift of the phase when synthesizing a sinusoidal waveform. A decoding unit decodes the data from an encoding side. The decoded data is transformed into the voiced/unvoiced data through a bad frame mask unit. Then, an unvoiced frame detecting circuit detects an unvoiced frame from the data. If there exist two or more continuous unvoiced frames, a voiced sound synthesizing unit initializes the phases of a fundamental wave and its harmonic into a given value such as 0 or $\pi/2$. This makes it possible to initialize the phase shift between the unvoiced and the voiced frames at a start point of the voiced frame, thereby preventing degradation of acoustic quality such as distortion of a synthesized sound caused by dephasing.

10 Claims, 5 Drawing Sheets

FIG.2A
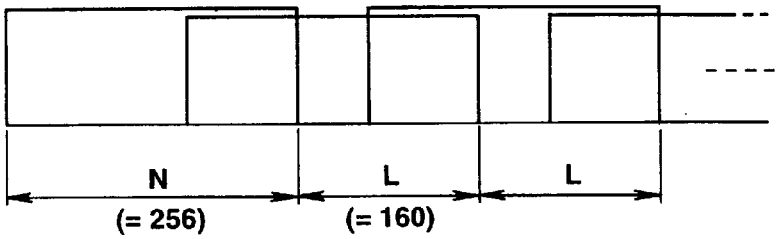
FIG.2B
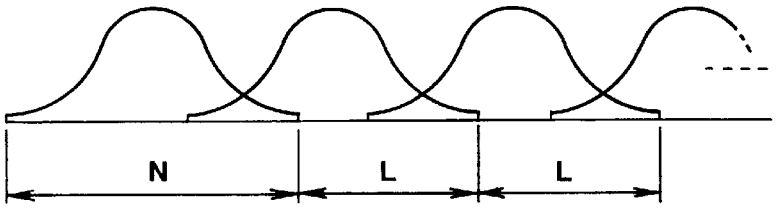
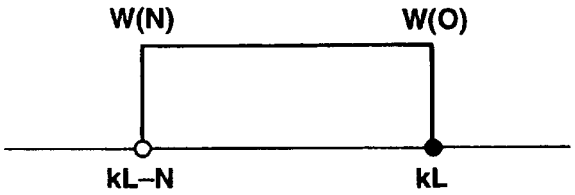
FIG.3
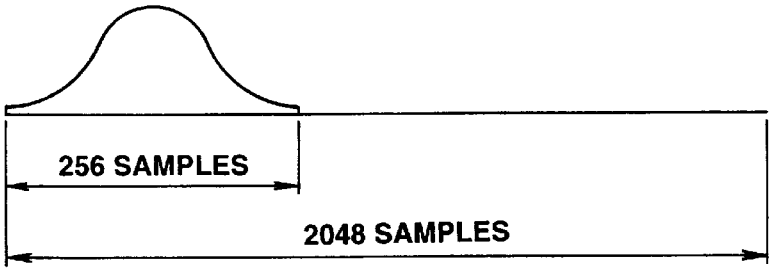
FIG.4

METHOD AND APPARATUS FOR SYNTHESIZING SPEECH

BACKGROUND OF THE INVENTION

1. Field of Industrial Application

The present invention relates to a method and an apparatus for synthesizing a speech using sinusoidal synthesis, such as the so-called MBE (Multiband Excitation) coding system and Harmonic coding system.

2. Description of the Related Art

There have been proposed several kinds of coding methods in which a signal is compressed by using a statistical property of an audio signal (containing a speech signal and an acoustic signal) in a time region and a frequency region of the audio signal and characteristics of hearing sense. These kinds of coding methods may be roughly divided into a coding method in a time region, a coding method for a frequency region, a coding method executed through the effect of analyzing and synthesizing an audio signal, and the like.

The high-efficient coding method for a speech signal contains an MBE (Multiband Excitation) method, an SBE (Singleband Excitation) method, a Harmonic coding method, an SBC (Sub-band Coding) method, an LPC (Linear Predictive Coding) method, a DCT (Discrete Cosine Transform) method, a MDCT (modified DCT) method, an FFT (Fast Fourier Transform) method, and the like.

Among these speech coding methods, the methods using a sinusoidal synthesis in synthesizing a speech, such as the MBE coding method and the Harmonic coding method, perform the interpolation about an amplitude and a phase, based on the data coded by and sent from an encoder such as the harmonic amplitude and phase data. According to the interpolated parameters, these methods are executed to derive a time waveform of one harmonic whose frequency and amplitude are changing according to time and summing up the same number of time waveforms as the number of the harmonics for synthesizing the waveforms.

However, the transmission of the phase data may be often restricted in order to reduce a transmission bit rate. In this case, the phase data for synthesizing sinusoidal waveforms may be a value predicted so as to keep the continuity on the frame border. This prediction is executed at each frame. In particular, the prediction is continuously executed in the transition from a voiced frame to an unvoiced frame and, vice versa.

In the unvoiced frame, no pitch exists. Hence, no pitch data is transmitted. This means that the predicative phase value deviates from a correct one as the phase is being predicted. This results in the predicative phase value gradually deviating from a zero phase addition or a $\pi/2$ phase addition, each of which has been originally expected. This deviation may degrade the acoustic quality of a synthesized sound.

SUMMARY OF THE INVENTION

It is an object of the present invention to provide a method and an apparatus for synthesizing a speech which prevents the adverse effect caused by the deviated phase when performing a process of synthesizing a speech through the effect of sinusoidal synthesis.

In carrying out the object, according to an aspect of the present invention, a speech synthesizing method includes the steps of sectioning an input signal derived from a speech signal into frames, deriving a pitch of each frame, determining if the frame contains either a voiced or an unvoiced sound, synthesizing a speech from data obtained by precedent steps, and wherein if the frame is determined to contain the voiced sound, the voiced sound is synthesized on the fundamental wave of the pitch and its harmonics, and if the frame is determined to contain the unvoiced sound, the phases of the fundamental wave and its harmonic are initialized at a given value.

According to another aspect of the present invention, a speech synthesizing apparatus includes means for sectioning an input signal derived from a speech signal into frames, means for deriving a pitch of each frame, determining if the frame contains either voiced or unvoiced sound, means for synthesizing a speech from data obtained by precedent means, means for synthesizing the voiced sound on the fundamental wave of the pitch and its harmonic if the frame contains the voiced sound, and means for initializing the phases of the fundamental wave and its harmonics into a given value if the frame contained the unvoiced sound.

In a case that two or more continuous frames are determined as the unvoiced sound, it is preferable to initialize the phases of the fundamental wave and its harmonic at a given value. Further, the input signal may be not only a digital speech signal digitally converted from a speech signal and a speech signal obtained by filtering the speech signal but also linear predictive coding (LPC) residual obtained by performing a linear predictive coding operation about a speech signal.

As mentioned above, for the frame determined as the unvoiced sound, the phases of the fundamental wave and its harmonic for sinusoidal synthesis are initialized into a given value. This initialization results in preventing the degrading of the sound caused by dephasing in the unvoiced frame.

Moreover, for two or more continuous unvoiced frames, the phases of the fundamental wave and its harmonic are initialized into a given value. This can prevent erroneous determination of the voiced frame as the unvoiced frame caused by a misdetection of the pitch.

Further objects and advantages of the present invention will be apparent from the following description of the preferred embodiments of the invention as illustrated in the accompanying drawings.

BRIEF DESCRIPTION OF THE DRAWINGS

FIGS. 2A and 2B are waveforms illustrating a windowing process;

FIG. 3 is a view for illustrating a relation between the windowing process and a window function;

FIG. 4 is a view showing data of a time axis to be orthogonally transformed (FFT);

DESCRIPTION OF THE PREFERRED EMBODIMENTS

Figure 1:
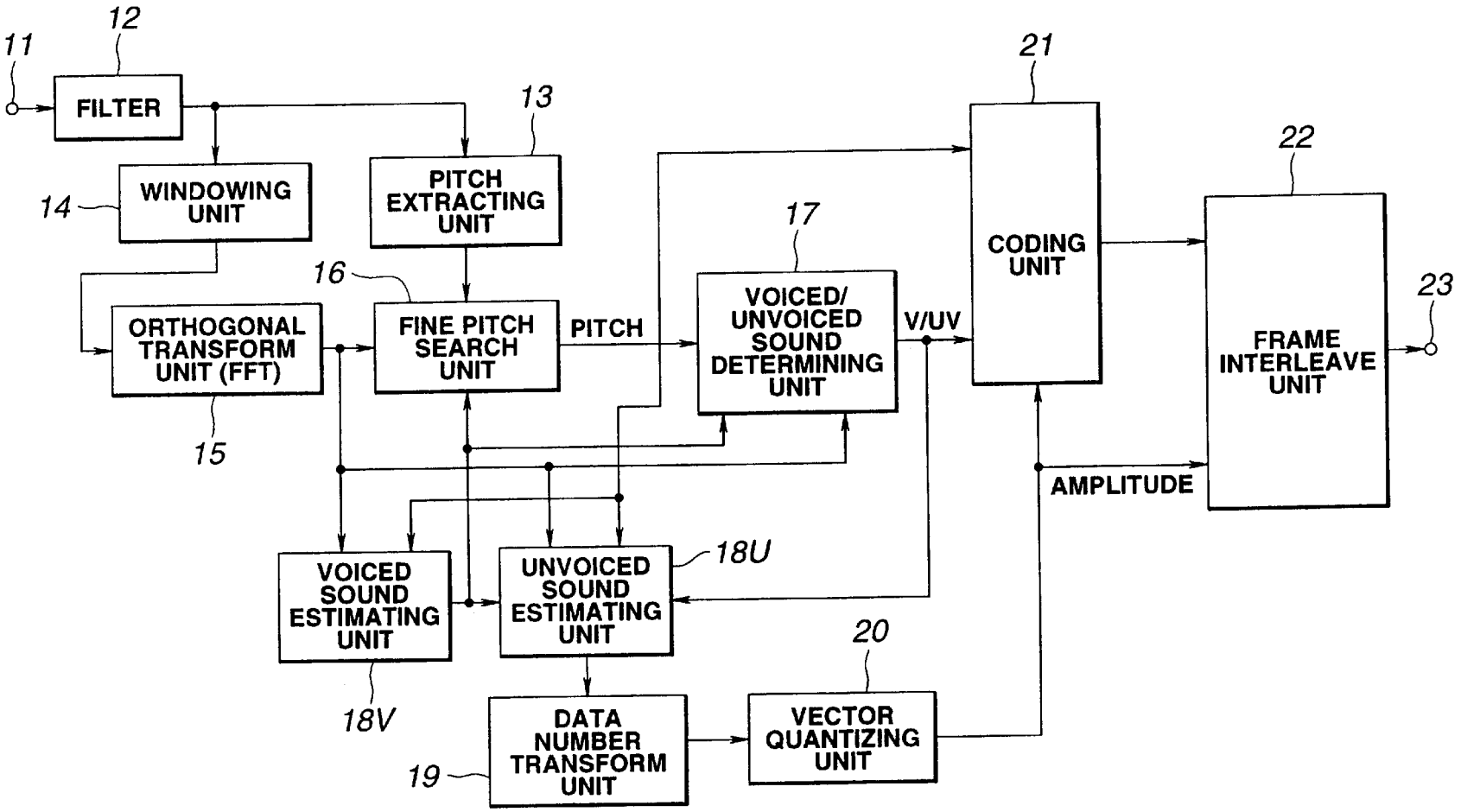
FIG. 1 is a functional block diagram showing a schematic arrangement of an analyzing side (encode side) of an analysis/synthesis coding apparatus for a speech signal according to an embodiment of the present invention.

The speech synthesizing method according to the present invention may be a sinusoidal synthesis coding method such as an MBE (Multiband Excitation) coding method, an STC (Sinusoidal Transform Coding) method or a harmonic coding method, or the application of the sinusoidal synthesis coding method to the LPC (linear Predictive Coding) residual, in which each frame served as a coding unit is determined as voiced (V) or unvoiced (UV) and, at a time of shifting the unvoiced frame to the voiced frame, the sinusoidal synthesis phase is initialized at a given value such as zero or $\pi/2$. For the MBE coding, the frame is divided into bands, each of which is determined as a voiced or an unvoiced one. At a time of shifting the frame in which all the bands are determined as the unvoiced into the frame in which at least one of the bands is determined as the voiced, the phase for synthesizing the sinusoidal waveforms is initialized into a given value.

This method just needs to constantly initialize the phase of the unvoiced frame without detecting the shift from the unvoiced frame to the voiced frame. However, misdetection of the pitch may cause the voiced frame to be erroneously determined as the unvoiced frame. By considering this, it is preferable to initialize the phase when two continuous frames are determined as the unvoiced or when three continuous frames or a greater predetermined continuous number of frames than three are determined as the unvoiced.

In a system for sending the other data rather than the pitch data in the unvoiced frame, the continuous phase prediction is difficult. Hence, in this system, as mentioned above, the initialization of the phase in the unvoiced frame is more effective. This prevents the sound quality from being degraded by de-phasing.

Later, the description will be oriented to an example of speech synthesis executed through the effect of normal sinusoidal synthesis before describing the concrete arrangement of a speech synthesizing method according to the present invention.

The data sent from the coding device or an encoder to a decoding device or a decoder for synthesizing a speech contains at least a pitch representing an interval between the harmonic and an amplitude corresponding to a spectral envelope.

As a speech coding method for synthesizing a sinusoidal wave on the decoding side, there have been known an MBE (Multiband Excitation) coding method and a harmonic coding method. Herein, the MBE coding method will be briefly described below.

The MBE coding method is executed to divide a speech signal into blocks at each given number of samples (for example, 256 samples), transforming the block into spectral data on a frequency axis through the effect of an orthogonal transform such as an FFT, extracting a pitch of a speech within the block, dividing the spectral data on the frequency axis into bands at intervals matched to this pitch, and determining if each divided band is either voiced or unvoiced. The determined result, the pitch data and the amplitude data of the spectrum are all coded and then transmitted.

The synthesis and analysis coding apparatus for a speech signal using MBE coding method (the so-called vocoder) is disclosed in D. W. Griffin and J. S. Lim, "Multiband Excitation Vocoder", IEEE Trans. Acoustics, Speech, and Signal Processing, vol.36, No.8, pp.1223 to 1235, August 1988. The conventional PARCOR (Partial Auto-Correlation) vocoder operates to switch a voiced section into an unvoiced one or vice versa at each block or frame when modeling a speech. On the other hand, the MBE vocoder is assumed to keep the voiced section and the unvoiced section on a frequency axis region of a given time (within one block or frame) when modeling the speech.

FIG. 1 is a block diagram showing a schematic arrangement of the MBE vocoder.

In FIG. 1, a speech signal is fed to a filter 12 such as a highpass filter through an input terminal 11. Through the filter 12, the DC offset component and at least the lowpass component (200 Hz or lower) for restricting the band (in the range of 200 to 3400 Hz, for example) are removed from the speech signal. The signal output from the filter 12 is sent to a pitch extracting unit 13 and a windowing unit 14.

As an input signal, it is possible to use the LPC residual obtained by performing the LPC process on the speech signal. In this process, the output of the filter 12 is reversely filtered with an $\alpha$ parameter derived through the effect of the LPC analysis. This reversely filtered output corresponds to the LPC residual. Then, the LPC residual is sent to the pitch extracting unit 13 and the windowing unit 14.

In the pitch extracting unit 13, the signal data is divided into blocks, each of which is composed of a predetermined number of samples N (N=256, for example) (or the signal data is cut out by a square window). Then, a pitch is extracted about the speech signal in each block. As shown in FIG. 2A, for example, the cut-out block (256 samples) is moved on the time axis and at intervals, each of which is composed of L samples (L=160, for example) between the frames. The overlapped portion between the adjacent blocks is composed of (N−L) samples (96 samples, for example). Further, the windowing unit 14 operates to perform a predetermined window function such as a hamming window with respect to one block (N samples) and sequentially move the windowed block on the time axis and at intervals, each of which is composed of one frame (L samples).

This windowing process may be represented by the following expression.

$$xw(k,q)=x(q)w(kL-q) \tag{1}$$

wherein k denotes a block number and q denotes a time index (sample number) of data. This expression (1) indicates that the windowing function w(kL−q) of the k-th block is executed on the q-th data x(q) of the original input signal for deriving data xw (k, q). In the pitch extracting unit 13, the square window as indicated in FIG. 2A is realized by the following windowing function wr(r):

$$\begin{aligned} wr(r) &= 1 \quad 0 \le r < N \\ &= 0 \quad r < 0,\ N \le r \end{aligned} \tag{2}$$

In the windowing process unit 14, the windowing function wh(r) for a Hamming window as shown in FIG. 2B may be represented by the following expression:

$$\begin{aligned} wh(r) &= 0.54 - 0.46 \cos(2\pi r/(N-1)) \quad 0 \le r < N \\ &= 0 \quad r < 0,\ N \le r \end{aligned} \tag{3}$$

In the case of using the windowing function wr(r) or wh(r), the non-zero interval of the windowing function w(r) (W=(KL−g)) indicated by the expression (1) is as follows:

$$0 \leqq kL-q < N$$

By transforming this expression, the following expression may be derived $$kL-N<q\leqq kL$$

Hence, for the square window, the windowing function wr(kL−q)=1 is given when kL−N<q≦kL as indicated in FIG. 3. In addition, the foregoing expressions (1) to (3) indicate that the window having a length of N (=256) samples is moved forward L (=160) samples by L samples. The non-zero sample sequence at each N point (0≦r<N) cut out by the windowing function indicated by the expression (2) or (3) is represented as xwr(k, r), xwr (k, r).

In the windowing process unit 14, as shown in FIG. 4, zeros of 1792 samples are inserted into the sample sequence xwh(k, r) of 256 samples of one block to which the humming window indicated in the expression (3) is applied. The resulting data sequence on the time axis contains 2048 samples. Then, an orthogonal transform unit 15 operates to perform an orthogonal transform such as an FFT (Fast Fourier Transform) with respect to this data sequence on the time axis. Another method may be provided for performing the FFT on the original sample sequence of 256 samples with no zeros inserted. This method is effective in reducing the processing amount.

The pitch extracting unit (pitch detecting unit) 13 operates to extract a pitch on the basis of the sample sequence (N samples of one block) represented as xwr(k, r). There have been known some methods for extracting a pitch, each of which uses a periodicity of a time waveform, a periodic frequency structure of spectrum or an auto-correlation function respectively, for example. In this embodiment, the pitch extracting method uses an auto-correlation method of a center-clipped waveform. The center clipping level in a block may be set as one clip level for one block. In actual practice, the clipping level is set by the method for dividing one block into sub-blocks, detecting a peak level of a signal of each sub-block, and gradually or continuously changing the clip level in one block if a difference of a peak level between the adjacent sub-blocks is large. The pitch periodicity is determined on the peak location of the auto-correlation data about the center-clipped waveform. Concretely, plural peaks are derived from the auto-correlation data (obtained from the data (N samples in one block)) about the current frame. When the maximum peak of these peaks is equal to or larger than a predetermined threshold value, the maximum peak location is set as a pitch periodicity. Except that, another peak is derived in the pitch range that meets a predetermined relation with a pitch derived from the other frame rather than the current frame, for example, the previous or the subsequent frame, as an example, in the ±20% range around the pitch of the previous frame. Based on the derived peak, the pitch of the current frame is determined. In the pitch extracting unit 13, the pitch is relatively roughly searched in an open loop. The extracted pitch data is sent to a fine pitch search unit 16, in which a fine search for a pitch is executed in a closed loop. In addition, in place of the center-clipped waveform, the auto-correlated data of a residual waveform derived by performing the LPC analysis about an input waveform may be used for deriving a pitch.

The fine pitch search unit 16 receives coarse pitch data of integral values extracted by the pitch extracting unit 13 and the data on the frequency axis fast-Fourier transformed by the orthogonal transform unit 15. (This Fast Fourier Transform is an example.) In the fine pitch search unit 16, some pieces of optimal floating fine data are prepared on the plus side and the minus side around the coarse pitch data value. These data are arranged in steps of 0.2 to 0.5. The coarse pitch data is purged into the fine pitch data. This fine search method uses the so-called Analysis by Synthesis method, in which the pitch is selected to locate the synthesized power spectrum at the nearest spot of a power spectrum of an original sound.

Figure 5A:
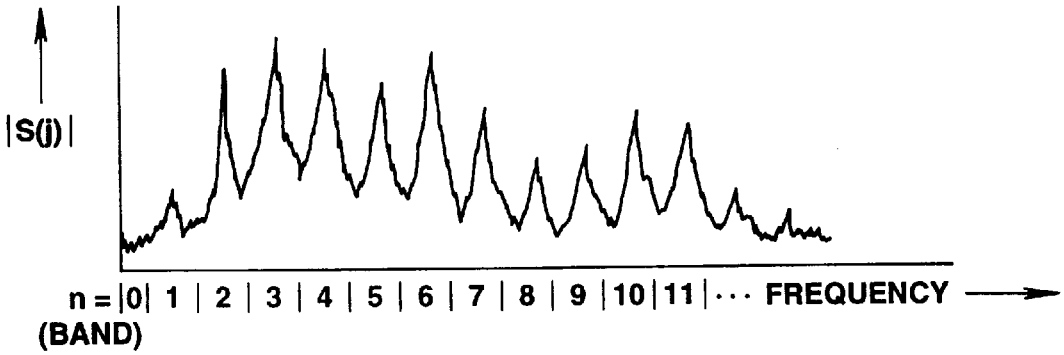
FIGS. 5A, 5B, and 5C are waveforms showing spectrum data on a frequency axis, a spectrum envelope, and a power spectrum of an excitation signal, respectively.
Figure 5B:
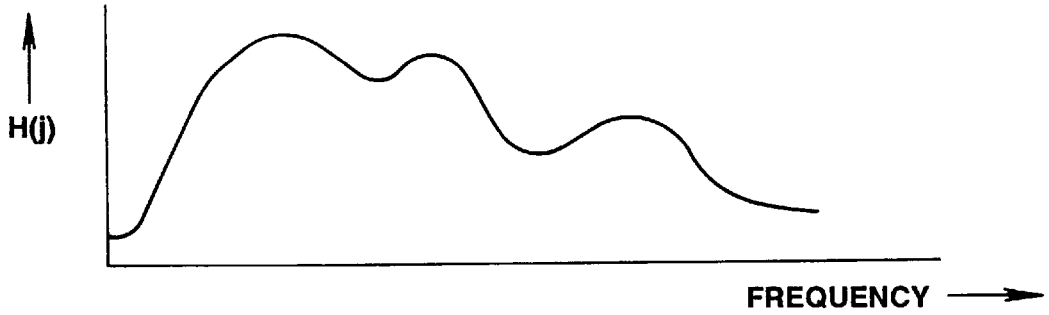
Figure 5C:
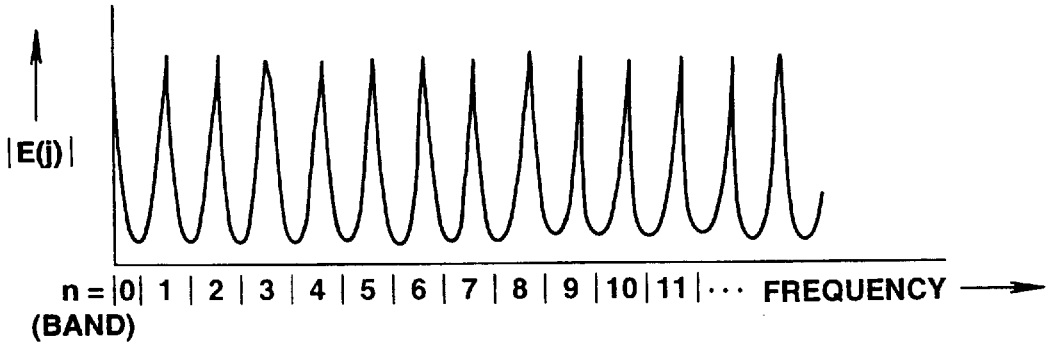

Now, the description will be oriented to the fine search for the pitch. In the MBE Vocoder, a model is assumed to represent the orthogonally transformed (Fast-Fourier Transformed, for example) spectral data S(j) on the frequency axis as:

$$S(j)=H(j)|E(j)|0<j<J \tag{4}$$

wherein J corresponds to ωs/4π=fs/2 and if the sampling frequency fs=ωs/2π is 8 kHz, for example, J corresponds to 4 kHz. In the expression (4), when the spectrum data S(j) on the frequency axis has a waveform as indicated in FIG. 5A, H(j) denotes a spectral envelope of the original spectrum data S(j) as indicated in FIG. 5B. E(j) denotes a periodic excitation signal on the equal level as indicated in FIG. 5C, that is, the so-called excitation spectrum. That is, the FFT spectrum S(j) is modeled as a product of the spectral envelope H(j) and the power spectrum |E(j)| of the excitation signal.

By considering the periodicity of the waveform on the frequency axis determined on the pitch, the power spectrum ¦E(j)¦ of the excitation signal is formed by repetitively arranging the spectrum waveform corresponding to the waveform of one band at bands of the frequency axis. The waveform of one band is formed by performing the FFT on the waveform composed of 256 samples of the Hamming window function added to zeros of 1792 samples, that is, inserted by zeros of 1792 samples, in other words, the waveform assumed as a signal on the time axis, and cutting out the impulse waveform of a given band width on the resulting frequency axis at the pitches.

For each of the divided bands, the operation is executed to derive a representative value of H(j), that is, a certain kind of amplitude |Am| that makes an error of each divided band minimal. Assuming that the lower and the upper limit points of the m-th band, that is, the band of the m-th harmonic are denoted as am and bm, respectively, the error Em of the m-th band is represented as follows:

$$em = \sum_{j=a_m}^{b_m} \{|S(j)| - |A_m||E(j)|\}^2 \tag{5}$$

The amplitude of |Am| that minimizes the error em is thus represented as follows:

$$\begin{aligned} \frac{\partial \epsilon_m}{\partial |A_m|} &= -2\sum_{j=a_m}^{b_m} \{|S(j)| - |A_m||E(j)|\}|E(j)| \\ &= 0 \\ \therefore |A_m| &= \sum_{j=a_m}^{b_m} |S(j)||E(j)| \Big/ \sum_{j=a_m}^{b_m} |E(J)|^2 \end{aligned} \tag{6}$$

The amplitude |Am| of this expression (6) minimizes the error εm.

This amplitude |Am| is derived for each band. Then, the error em of each band defined in the expression (5) is derived by that amplitude |Am|. Next, the operation is executed to derive a sum Σεm of the errors εm of all the bands. The error sum Σεm of all the bands is derived about some pitches, which are a bit different from each other. Then, the operation is executed to derive the pitch that minimizes the sum Σεm of those pitches.

Concretely, with the rough pitch derived by the pitch extracting unit 13 as a center, the upper and lower some pitches are prepared at intervals of 0.25. For each of the pitches that are a bit different from each other, the error sum Σεm is derived. In this case, if the pitch is defined, the band width is determined. According to the expression (6), the error em of the expression (5) is derived by using the power spectrum |S(j)| and the excitation signal spectrum |E(j)| of the data on the frequency axis. Then, the error sum Σεm of all the bands is obtained from the errors εm. This error sum Σεm is derived for each pitch. The pitch for the minimal error sum is determined as the optimal pitch. As described above, the fine pitch search unit operates to derive the optimal fine pitch at intervals of 0.25, for example. Then, the amplitude |Am| for the optimal pitch is determined. The calculation of the amplitude value is executed in an amplitude estimating unit 18V of a voiced sound.

In order to simplify the description, the foregoing description about the fine search for the pitch has assumed that all the bands are voiced. As mentioned above, however, the MBE vocoder employs a model in which an unvoiced region exists at the same time on the frequency axis. For each band, hence, it is necessary to determine if the band is either voiced or unvoiced.

The optimal pitch from the fine pitch search unit 16 and the amplitude |Am| from the amplitude estimating unit (voiced) 18V are sent to a voiced/unvoiced sound determining unit 17, in which each band is determined to be voiced or unvoiced. This determination uses a NSR (noise to signal ratio). That is, the NSR of the m-th band, that is, NSRm is represented as:

$$NSR = \frac{\sum_{j=a_m}^{b_m} \{|S(j)| - |A_m||E(j)|\}^2}{\sum_{j=a_m}^{b_m} |S(j)|^2} \tag{7}$$

If the NSRm is larger than a predetermined threshold value $Th_1$ ($Th_1$=0.2, for example), that is, an error is larger than a given value, it is determined that the approximation of |Am| |E(j)| at the band to |S(j)| is not proper, in other words, the excitation signal |E(j)| is not proper as a base. This band is determined to be unvoiced. In other cases when it is determined that the approximation is somewhat excellent, the band is determined to be voiced.

If the input speech signal has a sampling frequency of 8 kHz, the overall band width is 3.4 kHz (in which the effective band ranges from 200 to 3400 Hz). The pitch lag (that is the number of samples corresponding to a pitch periodicity) from a higher voice of women to a lower voice of men ranges from 20 to 147. Hence, the pitch frequency varies from 8000/147≈54 Hz to 8000/20=400 Hz. It means that about 8 to 63 pitch pulses (harmonics) are provided in the overall band width of 3.4 kHz. Since the number of bands divided by the fundamental pitch frequency, that is, the number of the harmonics varies in the range of 8 to 63 according to the voice level (pitch magnitude), the number of voiced/unvoiced flags at each band is made variable accordingly.

In this embodiment, for each given number of bands divided at each fixed frequency bandwidth, the results of voiced/unvoiced determination are collected (or degenerated). More specifically, the operation is executed to divide a given bandwidth (0 to 4000 Hz, for example) containing a voiced band into $N_B$ (12, for example) bands and discriminate a weighted average value with a predetermined threshold value $Th_2$ ($Th_2$=0.2, for example) for determining if the band is either voiced or unvoiced.

Next, the description will be oriented to an unvoiced sound amplitude estimating unit 18U. This estimating unit 18U receives the data on the frequency axis from the orthogonal transform unit 15, the fine pitch data from the pitch search unit 16, the amplitude |Am| data from the voiced sound amplitude estimating unit 18V, and the data about the voiced/unvoiced determination from the voiced/unvoiced sound determining unit 17. The amplitude estimating unit (unvoiced sound) 18U operates to do the re-estimation of the amplitude so that the amplitude is again derived about the band determined to be unvoiced. The amplitude |Am|uv about the unvoiced band is derived from:

$$|A_m|_{uv} = \sqrt{\sum_{j=a_m}^{b_m} |S(j)|^2 / (b_m - a_m + 1)} \tag{8}$$

The amplitude estimating unit (unvoiced sound) 18U operates to send the data to a data number transform unit (a kind of sampling rate transform) unit 19. This data number transform unit 19 has different dividing numbers of bands on the frequency axis according to the pitch. Since the number of pieces of data, in particular, the number of pieces of amplitude data is different, the transform unit 19 operates to keep the number constant. That is, as mentioned above, if the effective band ranges up to 3400 kHz, the effective band is divided into from 8 to 63 bands according to the pitch. The number mMX+1 of the amplitude |Am| (containing the amplitude |Am| uv of the unvoiced band) data variably ranges from 8 to 63. The data number transform unit 19 operates to transform the variable number mMX+1 of pieces of amplitude data into a constant number M of pieces of data (M=44, for example).

In this embodiment, the operation is executed to add dummy data to the amplitude data of one block in the effective band on the frequency axis for interpolating the values from the last data piece to the first data piece inside of the block, magnify the number of pieces of data into $N_F$, and perform a band-limiting type $O_S$-times oversampling process about the magnified data pieces for obtaining $O_S$-folded number of pieces of amplitude data. For example, $O_S$=8 is provided. The $O_S$-folded number of amplitude data pieces, that is, (mMX+1)×$O_S$ amplitude data pieces are linearly interpolated for magnifying the number of amplitude data pieces into $N_M$. For example, $N_M$=2048 is provided. By thinning out N data pieces, the data is converted into the constant number M of data pieces. For example, M=44 is provided.

The data from the data number converting unit 19, that is, the constant number M of amplitude data pieces are sent to a vector quantizing unit 20, in which a given number of data pieces are grouped as a vector. The (main portion of) quantized output from the vector quantizing unit 20, the fine pitch data derived through a P or P/2 selecting unit from the fine pitch search unit 16, and the data about the voiced/unvoiced determination from the voiced/unvoiced sound determining unit 17 are all sent to a coding unit 21 for coding.

Each of these data can be obtained by processing the N samples, for example, 256 samples of data in the block. The block is advanced on the time axis and at a frame unit of the L samples. Hence, the data to be transmitted is obtained at the frame unit. That is, the pitch data, the data about the voiced/unvoiced determination, and the amplitude data are all updated at the frame periodicity. The data about the voiced/unvoiced determination from the voiced/unvoiced determining unit 17 is reduced or degenerated to 12 bands if necessary. In all the bands, one or more sectioning spots between the voiced region and the unvoiced region are provided. If a constant condition is met, the data about the voiced/unvoiced determination represents the voiced/unvoiced determined data pattern in which the voiced sound on the lowpass side is magnified to the highpass side.

Then, the coding unit 21 operates to perform a process of adding a CRC and a rate ½ convolution code, for example. That is, the important portions of the pitch data, the data about the voiced/unvoiced determination, and the quantized data are CRC-coded and then convolution-coded. The coded data from the coding unit 21 is sent to a frame interleave unit 22, in which the data is interleaved with the part (less significant part) of data from the vector quantizing unit 20. Then, the interleaved data is taken out of an output terminal 23 and then is transmitted to a synthesizing side (decoding side). In this case, the transmission covers send/receive through a communication medium and recording/reproduction of data on or from a recording medium.

Figure 6:
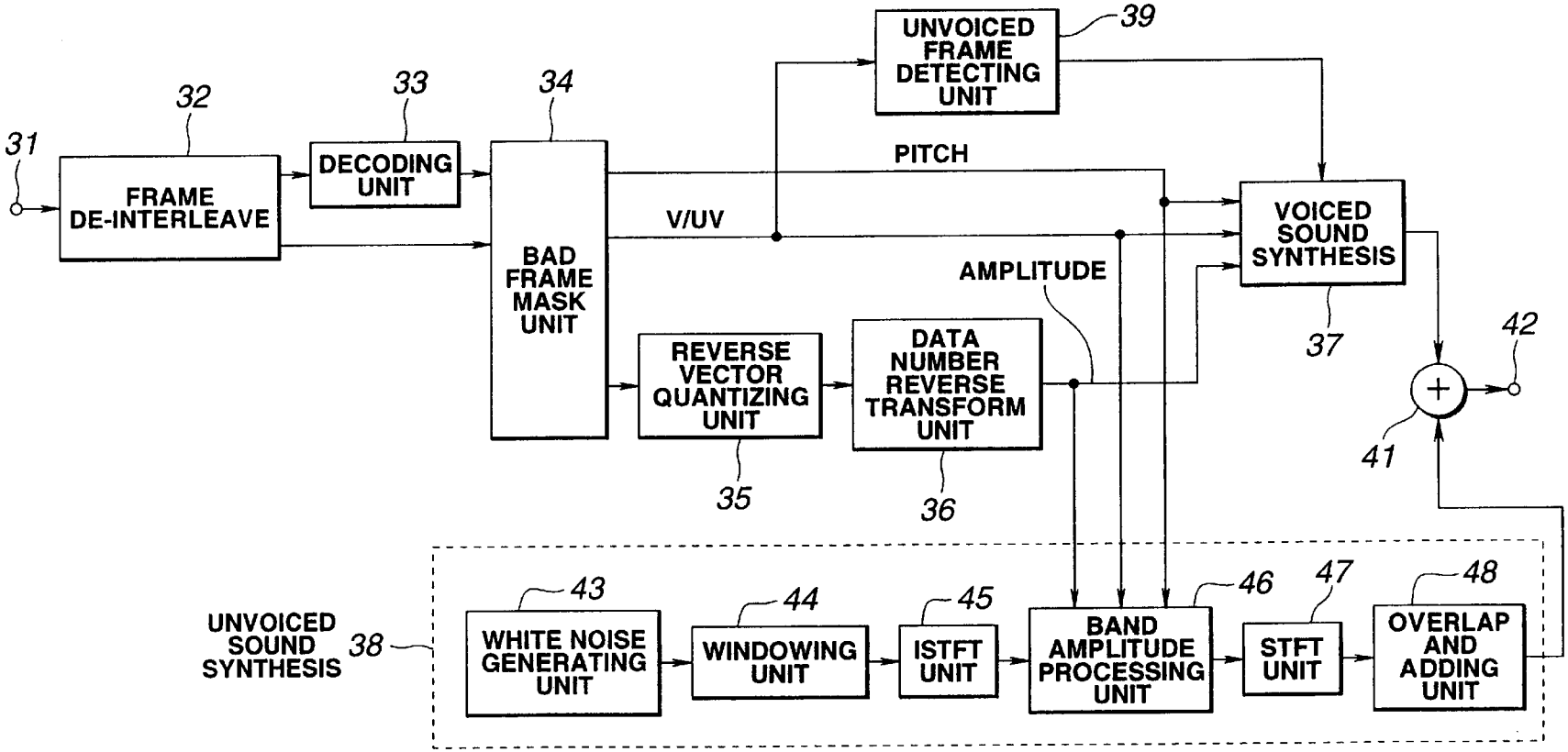
FIG. 6 is a functional block diagram showing a schematic arrangement of an synthesising side (decode side) of an analysis/synthesis coding apparatus for a speech signal according to an embodiment of the present invention.

In turn, the description will be oriented to a schematic arrangement of the synthesizing side (decode side) for synthesizing a speech signal on the basis of the foregoing data transmitted from the coding side with reference to FIG. 6.

In FIG. 6, ignoring a signal degrade caused by the transmission, that is, the signal degrade caused by the send/receive or recording/reproduction, an input terminal 31 receives a data signal that is substantially the same as the data signal taken out of the output terminal 23 of the frame interleave unit 22 shown in FIG. 1. The data fed to the input terminal 31 is sent to a frame de-interleaving unit 32. The frame de-interleaving unit 32 operates to perform the de-interleaving process that is reverse to the interleaving process formed by the circuit of FIG. 1. The more significant portion of the data CRC- and convolution-coded on the main section, that is, the encoding side is decoded by a decoding unit 33 and then is sent to a bad frame mask unit 34. The remaining portion, that is, the less significant portion is directly sent to the bad frame mask unit 34. The decoding unit 33 operates to perform the so-called betabi decoding process or an error detecting process with the CRC code. The bad frame mask unit 34 operates to derive the parameter of a highly erroneous frame through the effect of the interpolation and separately take the pitch data, the voiced/unvoiced data and the vector-quantized amplitude data.

The vector-quantized amplitude data from the bad frame mask unit 34 is sent to a reverse vector quantizing unit 35 in which the data is reverse-quantized. Then, the data is sent to a data number reverse transform unit 36 in which the data is reverse-transformed. The data number reverse transform unit 36 performs the reverse transform operation that is opposite to the operation of the data number transform unit 19 as shown in FIG. 1. The reverse-transformed amplitude data is sent to a voiced sound synthesizing unit 37 and the unvoiced sound synthesizing unit 38. The pitch data from the mast unit 34 is also sent to the voiced sound synthesizing unit 37 and the unvoiced sound synthesizing unit 38. The data about the voiced/unvoiced determination from the mask unit 34 is also sent to the voiced sound synthesizing unit 37 and the unvoiced sound synthesizing unit 38. Further, the data about the voiced/unvoiced determination from the mask unit 34 is sent to a voiced/unvoiced frame detecting circuit 39 as well.

The voiced sound synthesizing unit 37 operates to synthesize the voiced sound waveform on the time axis through the effect of the cosinusoidal synthesis, for example. In the unvoiced sound synthesizing unit 38, the white noise is filtered through a bandpass filter for synthesizing the unvoiced waveform on the time axis. The voiced sound synthesized waveform and the unvoiced sound synthesized waveform are added and synthesized in an adding unit 41 and then is taken out at an output terminal 42. In this case, the amplitude data, the pitch data and the data about the voiced/unvoiced determination are updated at each one frame (=L sample, for example, 160 samples) in the foregoing analysis. In order to enhance the continuity between the adjacent frames, that is, smooth the junction between the frames, each value of the amplitude data and the pitch data is set to each data value at the center of one frame, for example. Each data value between the center of the current frame and the center of the next frame (meaning one frame given when synthesizing the waveforms, for example, from the center of the analyzed frame to the center of the next analyzed frame, for example) is derived through the effect of the interpolation. That is, in one frame given when synthesizing the waveform, each data value at the tip sample point and each data value at the end sample point (which is the tip of the next synthesized frame) are given for deriving each data value between these sample points through the effect of the interpolation.

According to the data about the voiced/unvoiced determination, all the bands are allowed to be separated into the voiced region and the unvoiced one at one sectioning spot. Then, according to this separation, the data about the voiced/unvoiced determination can be obtained for each band. As mentioned above, this sectioning spot may be adjusted so that the voiced band on the lowpass side is magnified to the highpass side. If the analyzing side (encoding side) has already reduced (regenerated) the bands into a constant number (about 12, for example) of bands, the decoding side has to restore this reduction of the bands into the variable number of bands located at the original pitch.

Later, the description will be oriented to a synthesizing process to be executed in the voiced sound synthesizing unit 37.

The voiced sound Vm(n) of one synthesized frame (composed of L samples, for example, 160 samples) on the time axis in the m-th band (the band of the m-th harmonic) determined to be voiced may be represented as follows:

$$Vm(n)=Am(n)\cos(\theta m(n))\quad 0\leqq n<L \tag{9}$$

wherein n denotes a time index (sample number) inside of the synthesized frame. The voiced sounds of all the bands determined to be voiced are summed (ΣVm(n)) for synthesizing the final voiced sound V(n).

Am(n) of the expression (9) denotes an amplitude of the m-th harmonic interpolated in the range from the tip to the end of the synthesized frame. The simplest means is to linearly interpolate the value of the m-th harmonic of the amplitude data updated at a frame unit. That is, assuming that the amplitude value of the m-th harmonic at the tip (n=0) of the synthesize d frame is $A_{OM}$ and the amplitude value of the m-th harmonic at the end of the synthesized frame (n=L: tip of the next synthesized frame) is $A_{LM}$, Am(n) may be calculated by the following expression:

$$Am(n)=(L-n)A_{OM}/L+nA_{LM}/L \tag{10}$$

Next, the phase θm(n) of the expression (9) may be derived by the following expression:

$$\theta m(n)=m\omega 01n+n^2m(\omega L1-\omega 01)/2L+\phi 0m+\Delta\omega n \quad (11)$$

wherein ϕ0m denotes a phase (initial phase of a frame) of the m-th harmonic at the tip (n=0) of the synthesized frame, ω01 denotes a fundamental angular frequency at the tip (n=0) of the synthesized frame and ωL1 denotes a fundamental angular frequency at the end of the synthesized frame (n=L: tip of the next synthesized frame). Δω of the expression (11) is set to a minimal Δω that makes the phase fLm equal to θm(L) at n=L.

In any m-th band, the start of the frame is n=o and the end of the frame is n=L. The phase psi(L)m given when the end of the frame is n=L is calculated as follows:

$$psi(L)m=mod2\pi(psi(0)m+mL(\omega 0+\omega L)/2) \quad (12)$$

wherein psi(0)m denotes a phase given when the start of the frame is n=0, ω0 denotes a pitch frequency, ωL denotes a pitch frequency given when the end of the frame is n=L, and mod2π (x) is a function for returning a principal value of x in the range of −π to +π. For example, when x=1.3π, mod2π (x)=−0.7π is given. When x=2.3π, mod2π (x)=0.3π is given. When x=−1.3π, mod2π (x)=0.7π is given.

In order to keep the phases continuous, the value of the phase psi(L)m at the end of the current frame may be used as a value of the phase psi(0)m at the start of the next frame.

When the voiced frames are continued, the initial phase of each frame is sequentially determined. The frame in which all the bands are unvoiced makes the value of the pitch frequency ω unstable, so that the foregoing law does not work for all the bands. A certain degree of prediction is made possible by using a proper constant for the pitch frequency ω. However, the presumed phase is gradually shifted out of the original phase.

Hence, when all the bands are unvoiced in a frame, a given initial value of 0 or π/2 is replaced in the phase psi(L)m when the end of the frame is n=L. This replacement makes it possible to synthesize sinusoidal waveforms or cosinusoidal ones.

Based on the data about the voiced/unvoiced determination, the unvoiced frame detecting circuit 39 operates to detect whether or not there exist two or more continuous frames in which all the bands are unvoiced. If there exist two or more continuous frames, a phase initializing control signal is sent to a voiced sound synthesizing circuit 37, in which the phase is initialized in the unvoiced frame. The phase initialization is constantly executed at the interval of the continuous unvoiced frames. When the last one of the continuous unvoiced frame is shifted to the voiced frame, the synthesis of the sinusoidal waveform is started from the initialized phase.

This makes it possible to prevent the degradation of the acoustic quality caused by dephasing at the interval of the continuous unvoiced frames. In the system for sending another kind of information in place of the pitch information when there exist continuous unvoiced frames, the continuous phase prediction is made difficult. Hence, as mentioned above, it is quite effective to initialize the phase in the unvoiced frame.

Next, the description will be oriented to a process for synthesizing an unvoiced sound that is executed in the unvoiced sound synthesizing unit 38.

A white noise generating unit 43 sends a white noise signal waveform on the time axis to a windowing unit 44. The waveform is windowed at a predetermined length (256 samples, for example). The windowing is executed by a proper window function (for example, a Hamming window). The windowed waveform is sent to a STFT processing unit 45 in which a STFT (Short Term Fourier Transform) process is executed for the waveform. The resulting data is made to be a time-axial power spectrum of the white noise. The power spectrum is sent from the STFT processing unit 45 to a band amplitude processing unit 46. In the unit 46, the amplitude ¦Am¦ UV is multiplied by the unvoiced band and the amplitudes of the other voiced bands are initialized to zero. The band amplitude processing unit 46 receives the amplitude data, the pitch data, and the data about the voice/unvoiced determination.

The output from the band amplitude processing unit 46 is sent to the ISTFT processing unit 47. In the unit 47, the phase is transformed into the signal on the time axis through the effect of the reverse-STFT process. The reverse-STFT process uses the original white noise phase. The output from the ISTFT processing unit 47 is sent to an overlap and adding unit 48, in which the overlap and the addition are repeated as applying a proper weight on the data on the time axis for restoring the original continuous noise waveform. The repetition of the overlap and the addition results in synthesizing the continuous waveform on the time axis. The output signal from the overlap and adding unit 48 is sent to an adding unit 41.

The voiced and the unvoiced signals, which are synthesized and returned to the time axis in the synthesizing units 37 and 38, are added at a proper fixed mixing ratio in the adding unit 41. The reproduced speech signal is taken out of an output terminal 42.

Figure 7:
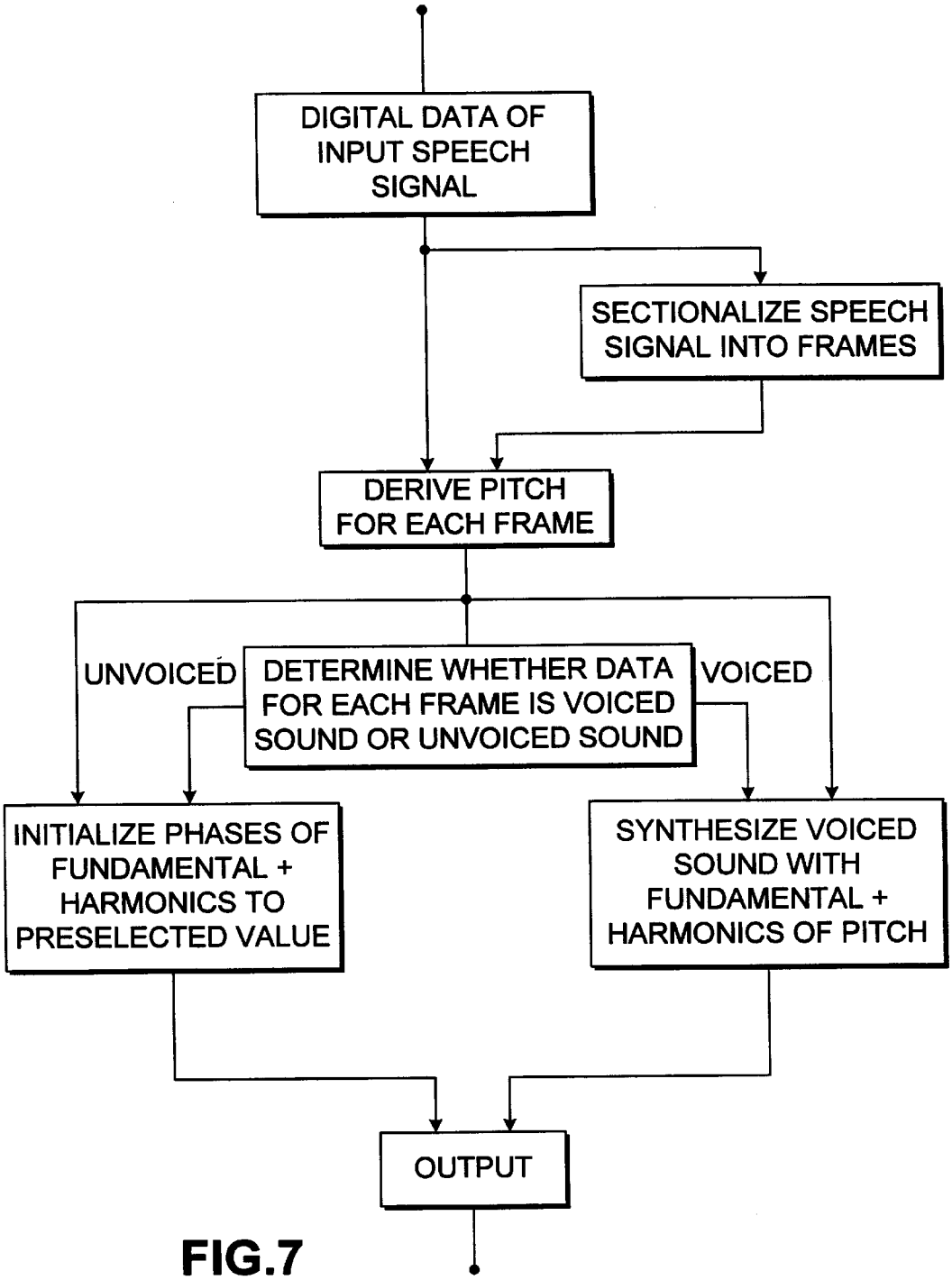
FIG. 7 is a flow-chart showing a method according to an embodiment of the present invention.

The present invention is not limited to the foregoing embodiments. For example, the arrangement of the speech synthesizing side (encode side) shown in FIG. 1 and the arrangement of the speech synthesizing side (decode side) shown in FIG. 6 have been described from a view of hardware. Alternatively, these arrangements may be implemented by software programs, for example, using the so-called digital signal processor performing the method shown in FIG. 7. The collection (regeneration) of the bands for each harmonic into a given number of bands is not necessarily executed, however, it may be done if necessary. The given number of bands is not limited to twelve. Further, the division of all the bands into the lowpass voiced region and the highpass unvoiced region at a given sectioning spot is not necessarily executed. Moreover, the application of the present invention is not limited to the multiband excitation speech analysis/synthesis method. In place, the present invention may be easily applied to various kinds of speech analysis/synthesis methods executed through the effect of sinusoidal waveform synthesis. For example, the method is arranged to switch all the bands of each frame into voiced or unvoiced and apply another coding system such as a CELP (Code-Excited Linear Prediction) coding system to the frame determined to be unvoiced. Or, the method is arranged to apply various kinds of coding systems to the LPC (Linear Predictive Coding) residual signal. In addition, the present invention may be applied to various ways of use such as transmission, recording and reproduction of a signal, pitch transform, speech transform, and noise suppression.

Many widely different embodiments of the present invention may be constructed without departing from the spirit and scope of the present invention. It should be understood that the present invention is not limited to the specific embodiments described in the specification, except as defined in the appended claims.

What is claimed is:

1. A speech synthesizing method including the steps of sectioning an input signal derived from a speech signal into frames and deriving a pitch for each sectioned frame, said method comprising the steps of:

determining whether data for synthesizing speech of each frame contains a voiced sound or an unvoiced sound;

synthesizing a voiced sound with a fundamental wave of said pitch and its harmonic when the data of a frame is determined to contain a voiced sound; and constantly initializing phases of said fundamental wave and its harmonic into a given value when the data of a frame is determined to contain an unvoiced sound.

2. The speech synthesizing method as claimed in claim 1, wherein the phases of the fundamental wave and its harmonic are initialized at the time of shifting from a frame determined to contain the unvoiced sound to a frame determined to contain the voiced sound.

3. The speech synthesizing method as claimed in claim 1, wherein the step of initializing is performed when it is determined there exist two or more continuous frames that contain the unvoiced sound.

4. The speech synthesizing method as claimed in claim 1, wherein the input signal is a linear predictive coding residual obtained by performing a linear predictive coding operation with respect to the speech signal.

5. The speech synthesizing method as claimed in claim 1, wherein the phases of the fundamental wave and its harmonic are initialized into zero or $\pi/2$.

6. A speech synthesizing apparatus arranged to section an input signal derived from a speech signal into frames and to derive a pitch for each frame, comprising:

means for determining whether data of each frame contains a voiced sound or an unvoiced sound;

means for synthesizing a voiced sound with a fundamental wave of the pitch and its harmonic when the data of a frame is determined to contain a voiced sound; and means for initializing the phase of said fundamental wave and its harmonic to a given value when the data of the frame is determined to contain an unvoiced sound.

7. The speech synthesizing apparatus as claimed in claim 6, wherein said means for initializing initializes the phases of said fundamental wave and its harmonic at a time of shifting from a frame determined to contain the unvoiced sound to a frame determined to contain the voiced sound.

8. The speech synthesizing apparatus as claimed in claim 6, wherein said means for determining determines when there exist two or more continuous frames determined to contain the unvoiced sound, whereupon the phases of said fundamental wave and its harmonic are initialized to the given value.

9. The speech synthesizing apparatus as claimed in claim 6, wherein said initializing means includes phase means that initializes the phases of said fundamental wave and its harmonic into zero or $\pi/2$.

10. The speech synthesizing apparatus as claimed in claim 6, wherein said input signal is a linear predictive coding residual obtained by performing a linear predicative coding operation with respect to a speech signal.

* * * * *